US011519687B1

(12) United States Patent
Stevens

(10) Patent No.: US 11,519,687 B1
(45) Date of Patent: Dec. 6, 2022

(54) BOW GRIP WITH CONTINUOUSLY ADJUSTABLE WRIST ANGLE

(71) Applicant: Bowtech, Inc., Eugene, OR (US)

(72) Inventor: Joshua Stevens, Harrisburg, OR (US)

(73) Assignee: BOWTECH, LLC, Eugene, OR (US)

( * ) Notice: Subject to any disclaimer, the term of this patent is extended or adjusted under 35 U.S.C. 154(b) by 0 days.

(21) Appl. No.: 17/505,464

(22) Filed: Oct. 19, 2021

(51) Int. Cl.
*F41B 5/14* (2006.01)
*F41B 5/10* (2006.01)

(52) U.S. Cl.
CPC ..... *F41B 5/10* (2013.01); *F41B 5/14* (2013.01); *F41B 5/1403* (2013.01)

(58) Field of Classification Search
CPC ..... F41B 5/00; F41B 5/14
See application file for complete search history.

(56) References Cited

U.S. PATENT DOCUMENTS 3,407,799 A * 10/1968 Bennett ..... F41B 5/0005 123/47 R
3,538,902 A * 11/1970 Fowkes ..... F41B 5/0031 124/88
4,966,124 A * 10/1990 Burling ..... F41B 5/14 124/88
5,081,979 A * 1/1992 Burling ..... F41B 5/14 124/88
5,243,958 A * 9/1993 Shepley, Jr. ..... F41B 5/0031 124/88
5,469,834 A * 11/1995 Higgins ..... F41B 5/14 124/88
5,551,413 A * 9/1996 Walk ..... F41B 5/14 124/88
5,615,663 A 4/1997 Simonds
5,842,460 A 12/1998 Barber
6,988,495 B1 1/2006 Van Hoorn
8,783,239 B2 * 7/2014 Vyprachticky ..... F41B 5/14 124/88
10,648,760 B2 5/2020 Gold et al.
10,648,761 B1 * 5/2020 Elezar ..... F41B 5/00
(Continued)

OTHER PUBLICATIONS

Clutch Grip Bowtech, https://bowtecharchery.com/accessories/clutch-grip/, 3 pages. Accessed Jul. 7, 2021.
(Continued)

*Primary Examiner* — John A Ricci
(74) *Attorney, Agent, or Firm* — Husch Blackwell LLP

(57) ABSTRACT

A grip assembly for an archery bow including an incrementally adjustable hand grip that can accommodate several customizable wrist positions for one or more archers without the use of separate attachments. The grip assembly includes a grip bed heel and a grip plate. The angle of the grip bed heel may be selectively adjusted relative to the riser by pivoting the grip bed heel. The grip plate may include an upper portion adapted to be coupled to the riser, a lower portion adapted to be coupled to the grip bed heel, and at least one flexible intermediate portion. The grip assembly can further include an adjustment mechanism for setting the angle of the grip bed heel and a securing mechanism for securing the grip bed heel in a desired angular position. The grip assembly can further include a biasing member applying a rotational counteracting force to the grip bed heel.

20 Claims, 7 Drawing Sheets

(56) References Cited

U.S. PATENT DOCUMENTS

| | | | | |
|---|---|---|---|---|
| 2002/0073983 | A1* | 6/2002 | Etheridge | F41B 5/14 124/88 |
| 2015/0211824 | A1* | 7/2015 | Vyprachticky | F41B 5/1403 124/88 |

OTHER PUBLICATIONS

DL Design—New ! DL Design EASYCLIP grip WIDE for all . . . Facebook, https://www.facebook.com/permalink.php?story_fbid=3544247592255479&id=267886756558262, 1 page, Accessed Jul. 7, 2021.

DL Design—Hoyt Invicta Grips Update ! Now you can . . . Facebook, https://www.facebook.com/permalink.php?story_fbid=252467120013231&id=100057498337809, 1 page, Accessed Jul. 7, 2021.

Hoyt Invicta Hoyt Archery, https://hoyt.com/compound-bows/invicta-37/technology, 13 pages. Accessed Jul. 7, 2021.

M.A.G.—Mathews Adjustable Grip System—Shrewd Archery, https://www.shredarchery.com/collections/grips/products/m-a-g-mathews-adjustable-grip-system, 8 pages. Accessed Jul. 7, 2021.

Storm Grip—Hoyt Target Bows Storm Archery, https://stormarchery.com/collections/storm-grip/products/full-set-storm-grip-hoyt-target-bows, 6 pages. Accessed Jul. 7, 2021.

Storm Grip—Mathews Bows Storm Archery, https://stormarchery.com/collections/storm-grip/products/full-set-storm-grip-mathews-bows, 6 pages. Accessed Jul. 7, 2021.

Storm Grip—PSE—Elite BOWS Storm Archery, https://stormarchery.com/collections/storm-grip/products/full-set-storm-grip-pse-target-bows, 6 pages. Accessed Jul. 7, 2021.

UltraView UltraGrip 2 for Hoyt Target Bows (High), https://www.lancasterarchery.com/ultraview-ultragrip-2-for-hoyt-target-bows-high.html, 3 pages. Accessed Jul. 7, 2021.

* cited by examiner

BOW GRIP WITH CONTINUOUSLY ADJUSTABLE WRIST ANGLE

CROSS-REFERENCE TO RELATED APPLICATIONS

None.

FIELD OF THE INVENTION

The present invention relates generally to archery equipment. More specifically, a grip assembly for archery bows with an adjustable hand grip to accommodate the desired wrist position(s) for an archer or multiple archers.

BACKGROUND OF THE INVENTION

Archery bows may be tuned and adjusted for optimal performance. Skilled archers tune their archery bows to finely control several factors, including adjusting or changing hand grips to accommodate their desired wrist position for comfort and consistency of use, whether a low wrist position, a high wrist position, or any intermediate wrist position therebetween.

Each archer has a desired position for his or her wrist when holding an archery bow, often unique to such archer. To ensure accuracy during use and that an arrow flies in a true and consistent path each time, it is crucial for the grip assembly of the archery bow to correspond with the archer's desired wrist position. If the grip assembly does not match the archer's desired wrist position, then the archer's hand may not contact or hold the hand grip in the proper manner or in the same manner every time the archer prepares to shoot an arrow. This can cause heeling, toeing, and torquing, thereby affecting accuracy and the arrow's intended flight path. Some archers go to great lengths to prevent heeling, toeing, and torquing and to ensure proper contact between their hand and the hand grip based on their desired wrist position(s).

Traditional bow grips are integrally formed with the riser of the bow. Such bow grips are not adjustable or otherwise able to accommodate an archer's unique wrist position. Conventional adjustable hand grips comprise replaceable modular attachments, including molded plastic or wood handles, that slide over or fasten to the outer surface of the grip area of the riser. Such replaceable modular attachments can accommodate certain archers' preferences, but they are limited to specific, discrete shapes and sizes, including those dictated by the most popular preferences among archers. These replaceable modular grips typically produce a larger or wider grip and provide a wider base for hand contact and can therefore increase the grip pressure and torque applied to the bow by an archer's hand, which can cause poor tuning and arrow flight, and inconsistent accuracy. Further, such replaceable modular attachments limit an archer's ability to customize or finely tune the grip. Further yet, modular grip attachments formed by injection-molding methods require separate molds for each attachment associated with a certain wrist position, which complicates the manufacturing process associated with such modular grip attachments. Additionally, in order to adequately secure such replaceable modular attachments to the bow grip or riser, several specialized or unique tools specific to such attachments may be required.

Accordingly, a need exists for an improved grip assembly that provides a selectively adjustable hand grip that can tunably accommodate several customizable wrist positions for an archer or several archers, including a low wrist position, a high wrist position, or any intermediate wrist position therebetween, without the use of separate attachments. A need also exists for an improved grip assembly that provides a selectively adjustable hand grip that can be more easily manufactured and adjusted or tuned without the use of specialized or unique tools. Further, a need exists for an improved grip assembly that may be incrementally adjusted such that it may be precisely adjusted to an archer's desired position.

SUMMARY

The present invention involves the provision of an archery bow having a riser, an upper limb, a lower limb, a bowstring, and a grip assembly. The riser may include an upper end, a lower end, and a grip portion disposed between the upper end and the lower end. The upper limb can be connected to an upper end of the riser and the lower limb can be connected to a lower end of the riser. The bowstring can extend generally between the upper limb and the lower limb. The grip assembly can be attached to the grip portion of the riser. The grip assembly can comprise a grip bed heel having a proximal end and a distal end, a pivot connection adjacent the proximal end of the grip bed heel, and a grip plate having an upper portion coupled to the riser and a lower portion coupled to the grip bed heel. The proximal end of the grip bed heel can be pivotally mounted to the riser and the angle of the grip bed heel can be selectively adjustable relative to the riser by pivoting the grip bed heel about the pivot connection. In doing so, the distal end of the grip bed heel may be selectively movable toward or away from the grip portion of the riser.

The grip assembly can include an adjustment mechanism operably coupled with the riser. The adjustment mechanism may include a threaded member that may be received at least partially within a cylindrical bore or aperture defined in the riser. The threaded member can be adjusted to varying depths such that the length or amount of the threaded member projecting from a rear surface of the riser may be varied. One end of the threaded member can be received within the riser, while the opposing end of the threaded member may contact the grip bed heel. The length or amount of the threaded member extending from the riser may be adjusted in order to adjust the angular position of the grip bed heel relative to the riser.

The grip assembly can also include a biasing member, such as a spring, that applies a linear or rotational force against the grip bed heel. In one embodiment, the biasing member engages the grip bed heel above the pivot connection and the adjustment mechanism engages the grip bed heel below the pivot connection. In such an embodiment, the biasing member applies a force against the grip bed heel in an rotational direction opposite to a bearing force applied to the grip bed heel by the adjustment mechanism. This keeps the grip bed heel engaged against the adjustment mechanism and/or directly against the riser in the case where the adjustment mechanism is not protruding from the riser.

The grip assembly may further include a securing mechanism adapted for securing the grip bed heel in a desired angular position. In one embodiment, the securing mechanism includes at least one guide track coupled to the grip bed heel and at least one fastening member. The guide track may defined a slot therethrough. The slot may be generally arcuate and concentric with the pivot connection of the grip assembly. To secure the grip bed heel in place, the fastening member, which may be a screw, passes through the slot and is received within the riser.

The grip plate grip can include at least one flexible intermediate portion located between its upper portion and lower portion. The flexible intermediate portion of the grip plate may include a section having a reduced cross-section relative to adjacent portions of the grip plate. Additionally, the flexible intermediate portion may have at least one void space defined therein. The void space may be partially or fully filled with a flexible material.

Another aspect of the present invention is directed to a riser having the grip assembly as described above, and a further aspect of the present invention is directed to a grip assembly that may be used in connection with an existing archery bow or riser, for example as an enhancement thereto or accessory therefore.

Objects and advantages pertaining to the grip assembly for archery bows with an adjustable hand grip may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In the accompanying drawings, which form a part of the specification and are to be read in conjunction therewith in which like reference numerals are used to indicate like or similar parts in the various views.

DETAILED DESCRIPTION OF EMBODIMENTS

Figure 1:
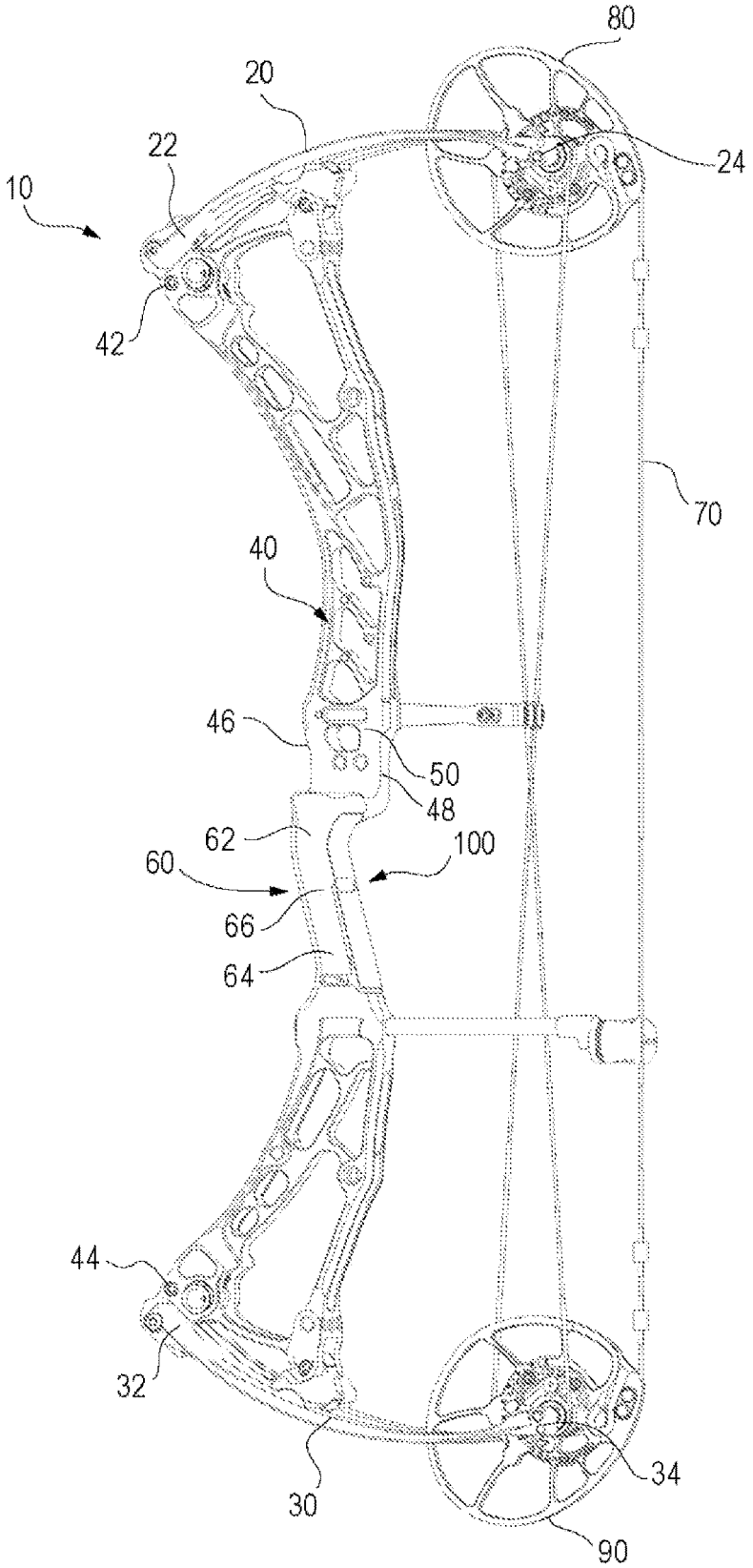
FIG. 1 is a side perspective view of an archery bow in accordance with one embodiment of the present invention.

Various embodiments of the present invention are described and shown in the accompanying materials, descriptions, instructions, and drawings. For purposes of clarity in illustrating the characteristics of the present invention, proportional relationships of the elements have not necessarily been maintained in the drawings. It will be understood that any dimensions included in the drawings are simply provided as examples and dimensions other than those provided therein are also within the scope of the invention.

The description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

One objective of the present invention is to provide an improved grip assembly for archery bows that provides a selectively adjustable hand grip that can tunably accommodate several customizable wrist positions for an archer or several archers through incremental or continuous adjustment or micro-adjustments to the angular position of the hand grip and without the use of independent modular or replaceable attachments. Another objective of the present invention is to provide an improved grip assembly that provides a selectively adjustable hand grip that can be manufactured with limited need for specialized tools and equipment. Yet another objective of the present invention is to provide an improved grip assembly that provides a selectively adjustable hand grip that can be easily adjusted or tuned without the use of specialized or unique tools. A preferred embodiment of the present invention is designed to provide (i) a grip assembly with a hand grip that is selectively adjustable and finely tunable to accommodate customizable wrist positions of nearly any preference along a large angular range and without the use of modular replaceable attachments, and (ii) a grip assembly with a selectively adjustable hand grip that can be more easily manufactured and adjusted or tuned through the use of a limited number of standard tools.

As shown in FIG. 1, an archery bow 10 can comprise an upper limb 20, a lower limb 30, and a riser 40. The upper limb 20 can have a proximal end 22 and a distal end 24 and, likewise, the lower limb 30 can also have a proximal end 32 and a distal end 34. The upper limb 20 and the lower limb 30 can extend from opposing ends of the riser 40, wherein the upper limb 20 is connected to the upper end 42 of the riser 40 and the lower limb 30 is connected to the lower end 44 of the riser 40. The riser 40 can further include a front surface 46 and an opposing archer-facing or rear surface 48 and define, relative to an archer, a left-side surface 50 and a right-side surface (not shown in FIG. 1), defining a generally quadrilateral cross section. However, it will be understood that the riser 40 can define a cross section of many shapes, including, without limitation, generally polygonal, rectangular, elliptical, circular, or other suitable shapes, and that the rise 40 may comprise varying and multiple cross-sectional shapes. Each of the front surface 46, rear surface 48, left-side surface 50, and right-side surface 52 can be flat or curved. Further, the riser 40 can define a general depth from front to rear, a general width from side to side, and a height from top to bottom. In one embodiment, the depth of the riser 40 can be greater than its width.

The riser 40 can also include a grip portion 60 defining a hand grip, which an archer can grasp with one hand to hold the archery bow 10 for shooting, and can be located between the upper and lower ends 42 and 44 of the riser 40. The grip portion 60 can comprise an upper portion 62, a lower portion 64, and an intermediate portion 66 disposed or located between the upper and lower portions 62 and 64. The grip portion 60 can define a general depth from front to rear, a general width from side to side, and a height from top to bottom. In one embodiment, the depth of the grip portion 60 can be greater than its width.

The archery bow 10 can be operated by the archer grasping the riser 40 about the grip portion 60 and pulling or drawing a bowstring 70 in a rearward direction away from the riser 40 with an opposite hand. The bowstring 70 can extend or be strung between the ends of the upper limb 20 and the lower limb 30 at points distant from the riser 40, including, without limitation, from an upper cam or pulley 80 located at the distal end 24 of the upper limb 20 and/or a lower cam or pulley 90 located at the distal end 34 of the lower limb 30. When shooting the archery bow 10, torque may be applied around an axis (not shown in FIG. 1) running longitudinally or vertically and centrally through the archery bow 10 and generally parallel to the bowstring 70. The torque acting on the archery bow 10 by the archer may unintentionally cause the archery bow 10 to rotate clockwise or counterclockwise around such longitudinal axis. For example, when grasping the grip portion 60, the archer's hand may induce the torque around the axis due to forces applied between the grip portion 60 and the archer's hand when the bowstring 70 is released.

Figure 2:
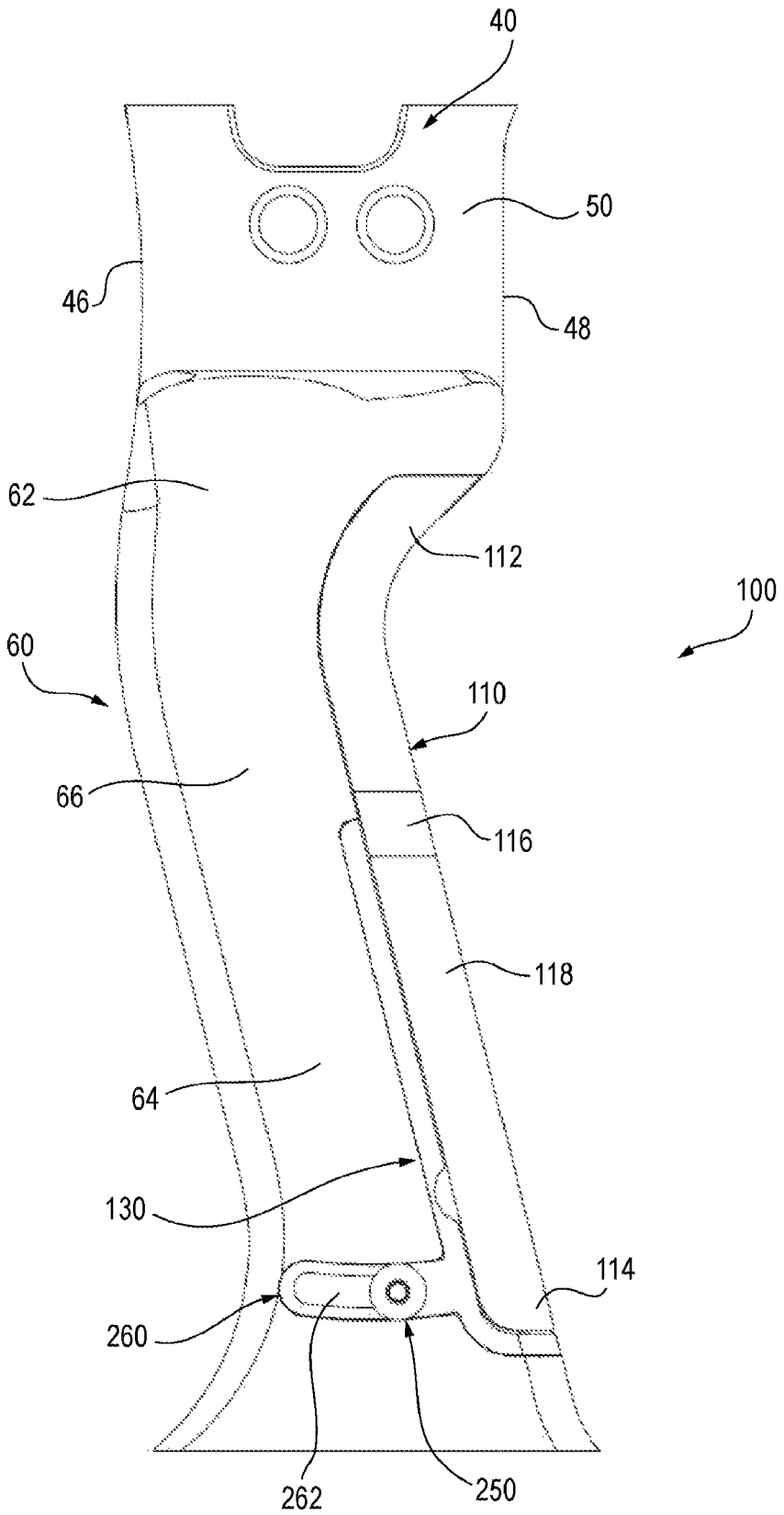
FIG. 2 is a partial side elevation view of the archery bow of FIG. 1.
Figure 3:
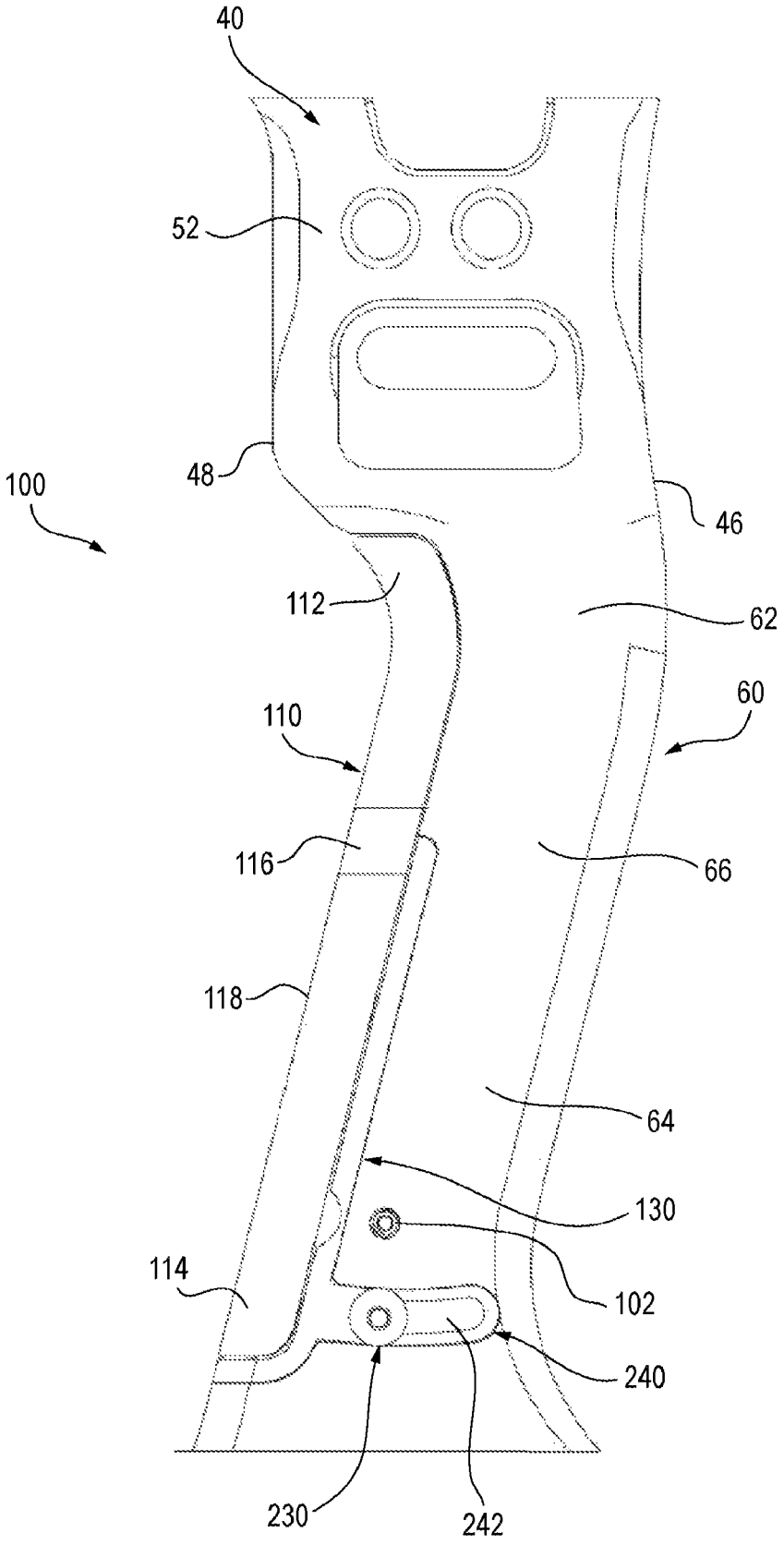
FIG. 3 is another partial side elevation view of the archery bow of FIGS. 1 and 2.

As further shown in FIGS. 1-3, in one embodiment, a grip assembly 100 can be attached relative to the grip portion 60. FIG. 2 depicts a partial side elevation view of the archery bow 10 from the left side of the archery bow 10, so that the left-side surface 50 is visible. FIG. 3 depicts a partial side elevation view of the archery bow 10 from the right side of the archery bow 10, so that the right-side surface 52 is visible. As illustrated in FIGS. 2 and 3, the grip assembly 100 can generally comprise a grip plate 110 and a grip bed assembly 130. The grip assembly 100 can define a general depth from front to rear and a general width from side to side. In one embodiment, the depth of the grip assembly 100 is less than or equal to the depth of the riser 40. Similarly, the width of the grip assembly 100 may be less than or equal to the width of the riser 40. The grip plate 110 can be operably coupled to the grip bed assembly 130. In one embodiment, the grip plate 110 can be removably secured to the grip bed assembly 130 in a snap-fit manner or similar interference-fit manner.

The grip plate 110 can generally comprise a upper portion or section 112, a lower portion or heel section 114, and an intermediate portion or section 116 disposed or located between the upper section 112 and the heel section 114. The upper section 112, heel section 114, and intermediate section 116 of the grip plate 110 can generally define a contoured archer-facing or rear surface 118 to contact the archer's hand. In one embodiment, the grip plate 110 can be formed of a nylon resin material, including, without limitation, Zytel®, or other suitable materials, including, without limitation, acrylonitrile butadiene styrene (ABS), polyethylene (PE), a polycarbonate (PC) and ABS blend, polyethylene terephthalate glycol (PETG), other suitable thermoplastic materials, and combinations of the foregoing. In another embodiment, the grip plate 110 can be formed by injection-molding or other suitable methods now known or hereafter developed. Further, the grip plate 110 can optionally be provided with a tacky, sticky, soft-touch or textured material on all or a portion of the back surface 118 to increase contact or grip with an archer's hand.

Figure 4:
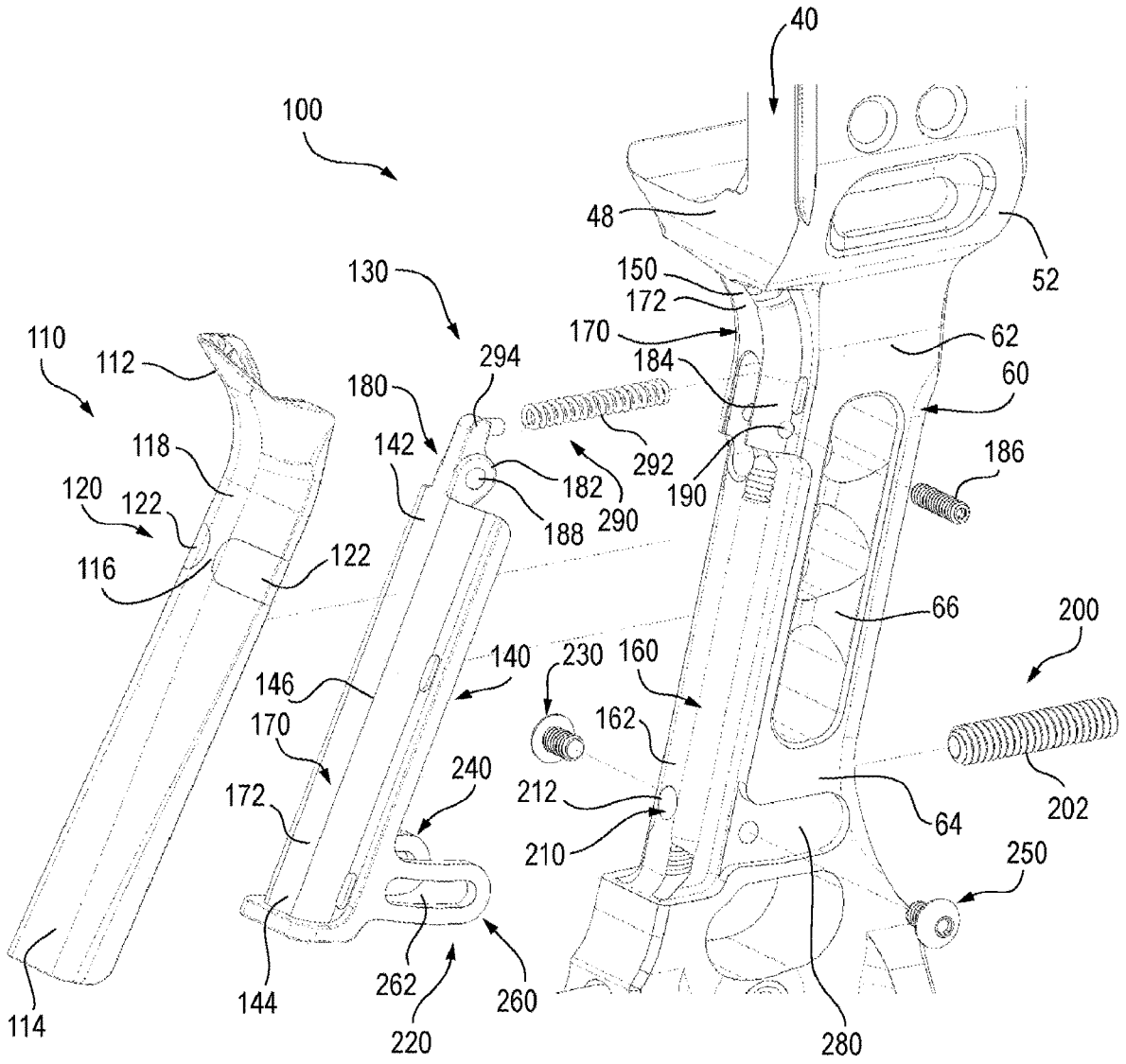
FIG. 4 is a perspective view of an exploded illustration of a grip assembly of an archery bow in accordance with one embodiment of the present invention.

In one embodiment, the upper section 112 and lower heel section of the grip plate 110 can be generally rigid, while the intermediate section 116 can be generally flexible. As best illustrated in FIG. 4, the flexible intermediate section 116 can comprise a flex region 120 defining a reduced lateral cross-section relative to other sections of the grip plate 110, including, without limitation, the upper section 112 and the heel section 114. In one embodiment, the reduced lateral cross-section of the flex region 120 can be formed of the same or similar materials as the upper section 112 and heel section 114, and the flex region 120 can define flexural portions 122 disposed within the voids defined by the reduced lateral cross-section of the flex region 120. The flexural portions 122 can be formed of a flexible material, including, without limitation, a urethane-based material, silicone-based material, elastomeric material, thermoplastic elastomer, any other flexible materials with a modulus of elasticity less than the rest of the grip plate 110, and combinations of the foregoing. In one embodiment, the flexural portions 122 can be formed by filling the voids defined by the reduced lateral cross-section of the flex region 120 with the desired material during manufacturing. This may be achieved in an overmolding, two-shot, or insert molding process, for example. In some embodiments, the grip plate 110 may comprise more than one flex region 120.

As best illustrated in FIG. 4, the grip bed assembly 130 can comprise a grip bed heel 140 and a throat portion or stationary grip bed 150. The grip bed heel 140 can generally comprise an upper or proximal portion 142 and a lower or distal portion 144, and define an outer surface 146. The grip bed heel 140 can be sized to fit into the palm of the hand of the archer, and when an archer holding the archery bow 10 extends his or her thumb or forefinger about opposite sides of the stationary grip bed 150, the archer's remaining fingers can extend along one side of the grip bed heel 140. In one embodiment, the grip bed heel 140 can be pivotally or rotatingly mounted to the grip portion 60, including at or near the proximal portion 142. This allows the position of the grip bed heel 140 to be selectively changed and adjusted to the preferences of the archer, including through continuous adjustment or micro-adjustments to the angular position of the grip bed heel 140. In another embodiment, the grip bed heel 140 can be pivotally mounted directly to the upper portion 62 of the grip portion 60, or a throat portion thereof, and be operably coupled directly to the riser 40. In yet another embodiment, the grip bed heel 140 can be pivotally mounted to the stationary grip bed 150. In one embodiment, the stationary grip bed 150 can be mounted to the grip portion 60, including, without limitation, at an upper portion 62 thereof. The grip bed heel 140 can be formed of a rigid material or alloy, including, without limitation, a glass-reinforced polymer, carbon-reinforced polymer, plastic material, metallic material, ceramic material, wood, composite-type materials, other suitable materials, or combinations of the foregoing. The rigid nature of the grip bed heel 140 can increase its durability and lifetime of the component. It will be appreciated that the grip plate 110 and grip bed heel 140 may be combined into a single component or may be separate components.

As further illustrated in FIG. 4, the grip portion 60 can comprise a grip bed assembly mounting portion 160 to interface with the grip bed assembly 130. The grip bed assembly mounting portion 160 can comprise a seat 162 which may be part of the riser 40, for example, by being formed by the riser 40, formed into the riser 40, or otherwise defined by a portion of the riser 40. The seat 162 can be adapted to receive, or be received by, at least a portion of the grip bed assembly 130, including the grip bed heel 140 as it may be pivotally adjusted during use. As shown in FIG. 4, in one embodiment, the seat 162 can comprise cut outs or a recessed region corresponding to the size and shape of the grip bed heel 140, and the grip bed heel 140 can comprise an internal channel, groove or opening extending substantially over the length of the grip bed heel 140. The recessed region of the seat 162 can receive the grip bed heel 140, and the grip bed heel 140 can mate with and fit over and receive the seat 162. In another embodiment, the grip bed assembly mounting portion 160 can be formed with substantially parallel, flat sides, and the grip bed heel 140 can comprise corresponding substantially parallel, flat internal sides defining the internal channel, groove or opening extending substantially over the length of the grip bed heel 140, so that the grip bed heel 140 can mate with and fit over and receive the grip bed assembly mounting portion 160.

As shown in FIG. 4, the grip bed assembly 130 may include a grip plate mounting portion 170 to interface with the grip plate 110. The grip plate mounting portion 170 can comprise a seat 172 which may be part of the riser 40, for example, by being formed by the grip bed heel 140 formed into the grip bed heel 140, or otherwise defined by a portion of the grip bed heel 140. The seat 172 can be adapted to receive, or be received by, at least a portion of the grip plate 110, including when the grip plate 110 is operably coupled with the grip bed assembly 130. In one embodiment, the grip bed heel 140 can define at least part of the grip plate mounting portion 170. The stationary grip bed 150 can also define at least part of the grip plate mounting portion 170. As shown in FIG. 4, the grip bed heel 140 together with the stationary grip bed 150 can define the grip plate mounting portion 170. As further illustrated in FIG. 4, the seat 172 can comprise cut outs or a recessed region corresponding to the size and shape of the grip plate 110, and the grip plate 110 can comprise an internal channel, groove or opening extending substantially over the length of the grip plate 110. The recessed region of the seat 172 can receive the grip plate 110, and the grip plate 110 can mate with and fit over and receive the seat 172, including, without limitation, in a snap-fit manner or similar snug or interference-fit manner. The grip plate 110 can conform to or generally surround a substantial portion of the grip bed assembly 130 when coupled thereto, including, without limitation, surrounding the grip bed heel 140, the stationary grip bed 150, and a hinge 180, as described in further detail below. By conforming to and concealing at least a substantial portion of the grip bed assembly 130, the grip plate 110 can function to create a continuous hand feel over the vertical length of the grip assembly 100 and create a smooth transition between grip bed heel 140 and the stationary grip bed 150 and conceal any pinch point created by mounting the grip bed heel 140 to the grip portion 60. In one embodiment, the grip plate mounting portion 170 can be formed with substantially parallel, flat sides, and the grip plate 110 can comprise corresponding substantially parallel, flat internal sides defining an internal groove or opening extending substantially over the length of the grip plate 110, so that the grip plate 110 can mate with and fit over and receive the grip plate mounting portion 170.

In one embodiment, the grip bed heel 140 may include a hinge 180. As shown in FIG. 4, the hinge 180 can comprise a first knuckle 182 attached to the grip bed heel 140, a second knuckle 184 attached to the stationary grip bed 150, and a pin 186 that may be received within a central opening 188 of the first knuckle 182 and a central opening 190 of the second knuckle 184. When the pin 186 is placed within the openings 188 and 190 of the first and second knuckles 182 and 184, the hinge 180 can rotatingly pivot about the pin 186, which in turn can allow the grip bed heel 140 to rotatingly pivot relative to the stationary grip bed 150.

As shown in FIG. 4, the grip assembly 100 can further comprise an adjustment mechanism 200 and a securing mechanism 220. The adjustment mechanism 200 can be operably coupled to or received by the riser 40 and comprise a linear portion 202 adapted for insertion into or out of the riser 40 to varying depths. One end of the adjustment mechanism 200 can contact or abut a portion of the grip bed heel 140 to provide a bearing reaction force on the grip bed heel 140 when engaged by the archer. In this way, the grip assembly 100 can be actuated angularly through precise continuous angular adjustments. In one embodiment, the angular position of the grip assembly 100 can be selectively adjusted through continuous adjustment or micro-adjustments, by selectively adjusting the fore-and-aft position of the adjustment mechanism 200. Adjusting the angular position of the grip bed heel 140 can cause the distal portion 144 to generally move toward or away from the grip portion 60 of the riser 40. In one embodiment, flexible intermediate section 116 can allow for bending or angular adjustments in the shape of the grip plate 110, which can accommodate the angular position of the grip bed assembly 130, including when the grip bed heel 140 is selectively changed and adjusted to the preferences of the archer, including through continuous adjustment or micro-adjustments to the angular position of the grip bed heel 140. The adjustment mechanism 200 can be a threaded fastener, including, without limitation, a screw, and can be selectively screwed into and out of the riser 40. Selectively turning the threaded fastener can vary the depth of the adjustment mechanism 200 within the riser 40 and, thus, the portion of the adjustment mechanism 200 extending beyond the rear surface or seat 162 of the riser 40.

In one embodiment, a tool (not shown), including, without limitation, a screw driver, Allen wrench, hex key, or other suitable device can be used to selectively turn the adjustment mechanism 200 thereby screwing it into or out of the riser 40. The length that the adjustment mechanism 200 extends beyond the rear surface or seat 162 of the riser 40 can correspond to the position (and angle) of the distal portion 144 of the grip bed heel 140 relative to the grip portion 60 of the riser 40. In one embodiment, the adjustment mechanism 200 can terminate in a ball portion (not shown) that can directly abut the grip bed heel 140. In yet another embodiment, the ball portion can be a ball-headed bolt and comprise a solid spherical element received in a corresponding recess defined in the grip bed heel 140.

As further shown in FIG. 4, the riser 40 may include a cylindrical bore 210 defined at least partially therein. It will be appreciated that the cylindrical bore 210 may optionally extend entirely therethrough. The cylindrical bore 210 can receive the adjustment mechanism 200 to varying depths, including, without limitation, in a threaded fashion. The cylindrical bore 210 can optionally be countersunk or beveled to keep any inserts or threaded fasteners out of the way of an archer's grip. In one embodiment, the cylindrical bore 210 can have a first aperture 212 on the archer-facing or rear surface 48 of the riser 40. In another embodiment, where the cylindrical bore 210 extends entirely through the riser 40, it may have a second aperture (not shown in FIG. 4) on the opposing front surface 46 of the riser 40. In such an embodiment, the cylindrical bore 210 can extend through the riser 40 from the first aperture 212 to the second aperture 214 to form a through-bore. The cylindrical bore 210 can further comprise threads to receive a threaded adjustment mechanism 200.

As illustrated in FIG. 3, a set screw 102 can optionally be used to selectively secure the adjustment mechanism 200 at a certain depth in the riser 40, including, without limitation, by abutting the linear portion 202 of the adjustment mechanism 200 when it is received in the cylindrical bore 210. The set screw 102 can be adjusted into or out of the riser 40 using a tool (not shown) such as a screw driver, Allen wrench, hex key, or other suitable tool. The set-screw bore hole defined in the riser 40 can be countersunk or beveled to keep any inserts or fasteners out of the way of an archer's grip. In one embodiment, the set-screw bore hole can intersect the cylindrical bore 210 in a substantially perpendicular manner, such that the set screw 102 can engage and secure the adjustment mechanism 200 in a substantially perpendicular manner when tightened.

A securing mechanism 220 can be coupled to the riser 40 and/or grip bed heel 140 and may be adapted for selectively securing the grip bed heel 140 in a desired position and prevent it from moving once it is secured. As best illustrated in FIG. 4, the securing mechanism 220 may include a first lateral guide track 240 and a second opposing lateral guide track 260 extending from the grip bed heel 140. The first guide track 240 can define an elongate slot, gap, or other opening (not shown in FIG. 4), and the second guide track 260 can define an elongate slot, gap, or other opening 262. The riser 40 can define a first seating channel (not shown in FIG. 4) generally corresponding to the size and shape of the first guide track 240 and a second seating channel 280 corresponding to the size and shape of the second guide track 260. The first and second lateral seating channels 270 and 280 can receive, respectively, the first and second guide tracks 240 and 260 as they move relative to the riser 40 when the grip bed heel 140 is pivotally adjusted.

In one embodiment, a first fastening member 230 can be inserted through the elongate slot 242 of the first guide track 240 and screwed into the riser 40, and a second fastening member 250 can be inserted through the elongate slot 262 of the second guide track 260 and screwed into the riser 40, in order to selectively secure the position of the position of the grip bed heel 140 relative to the riser 40. In doing so, the guide tracks 240 and 260 may be secured in their respective seating channels 270 and 280. The elongate slots 242 of the first guide track 240 and/or the elongate slot 262 of the second guide track 260 can define the limits to the pivotal movement of the grip bed heel 140 as it is pivotally adjusted during use.

In one embodiment, the first and second guide tracks 240 and 260 can each define generally arcuate shapes. Likewise, the first and second elongate slots 242 and 262 can also each define generally arcuate shapes. Such arcuate shapes may define an arc generally concentric with the pivot axis of the central opening 188 (i.e., pivot point or point of rotation) of the grip bed heel 140. These arcuate shapes, which are concentric with the pivot point of the grip bed heel 140, may allow the first and second elongate slots 242 and 262 to translate through an angular range of motion while the fastening members 230 and 250 are inserted, but not tightened, into the riser 40.

As shown in FIG. 4, the first and second guide tracks 240 and 260 can extend from the grip bed heel 140 in a substantially parallel manner to one another, including extending generally perpendicularly from the grip bed heel 140. In that regard, the first and second guide tracks 240 and 260 can define an opening therebetween that is adapted to receive a portion of the riser 40, including, without limitation, the grip portion 60. When the first and second guide tracks 240 and 260 receive the riser 40, fastening member 230 and/or fastening member 250 can be selectively and independently screwed into and out of the riser 40 to secure the grip bed heel 140 in a desired position relative to the riser 40. In this way, the first and second guide tracks 240 and 260 can provide stability to the grip assembly 100, including the grip bed heel 140, when engaged by the archer.

As shown in FIG. 4, the grip bed assembly 130 can optionally include a biasing assembly 290. The biasing assembly 290 can comprise a biasing member 292 and a connection member 294. In one embodiment, the biasing member 292 may be a compression spring or open-coil helical spring. However, it will be understood that the biasing member 292 may be any suitable biasing means, including, without limitation, a torsion spring. In the embodiment illustrated in FIG. 4, the connection member 294 can be connected to the grip bed heel 140, including at the proximal end 142. In one embodiment, the biasing member 292 can be received and seated within a void within the riser 40, including a cylindrical bore (not shown in FIG. 4) within the grip portion 60. The biasing member 292 can further receive and be coupled with the connection member 294.

In the embodiment shown in FIG. 4, the biasing member 292 can apply a biasing force to the connection member 294, which can cause the grip bed heel 140 to pivot or rotate. The biasing member 292 can apply a biasing force in an opposite rotational direction to the bearing force applied by the adjustment mechanism 200 when the same abuts a portion of the grip bed heel 140. In such an embodiment, as the position of the distal portion 144 of the grip bed heel 140 is being selectively adjusted toward or away from the grip portion 60 by translating the adjustment mechanism 200 laterally relative to the riser 40, the biasing assembly 290 can provide a moderate rotational counteracting force. By providing a moderate rotational counteracting force, the biasing assembly 290 can aid to ensure that the grip bed heel 140 maintains near-constant contact with the abutted adjustment mechanism 200. It will be understood, however, that the moderate rotational counteracting force applied by the biasing assembly 290 can be overcome by the bearing force applied to the grip bed heel 140 by the adjustment mechanism 200 when the adjustment mechanism 200 is selectively screwed into and out of the riser 40 to vary the depth of the adjustment mechanism 200 relative to the riser 40. Therefore, in one embodiment, the moderate rotational counteracting force applied by the biasing assembly 290 will not prevent the grip bed heel 140 from being selectively adjusted toward or away from the grip portion 60.

For most archers, a comfortable hand grip can be achieved by selectively adjusting the pivotal or rotational position of the grip assembly 100. As discussed herein, the position of the grip bed heel 140 of the grip assembly 100, which can be pivotally mounted to the riser 40 through the use of a hinge 180, can be changed and adjusted to meet the preferences of the archer and be comfortably received within his or her hand. As best shown in FIGS. 5-10, the grip assembly 100, including the rear surface 118 of the grip plate 110, can define a certain grip angle θ relative to an axis 500 running longitudinally or vertically and centrally through the archery bow 10. The grip angle θ may also be defined between a longitudinal axis generally parallel to the bowstring 70. As discussed in greater detail below, in one embodiment, the grip angle θ may be adjusted by a magnitude of up to 10° or more.

Figure 5:
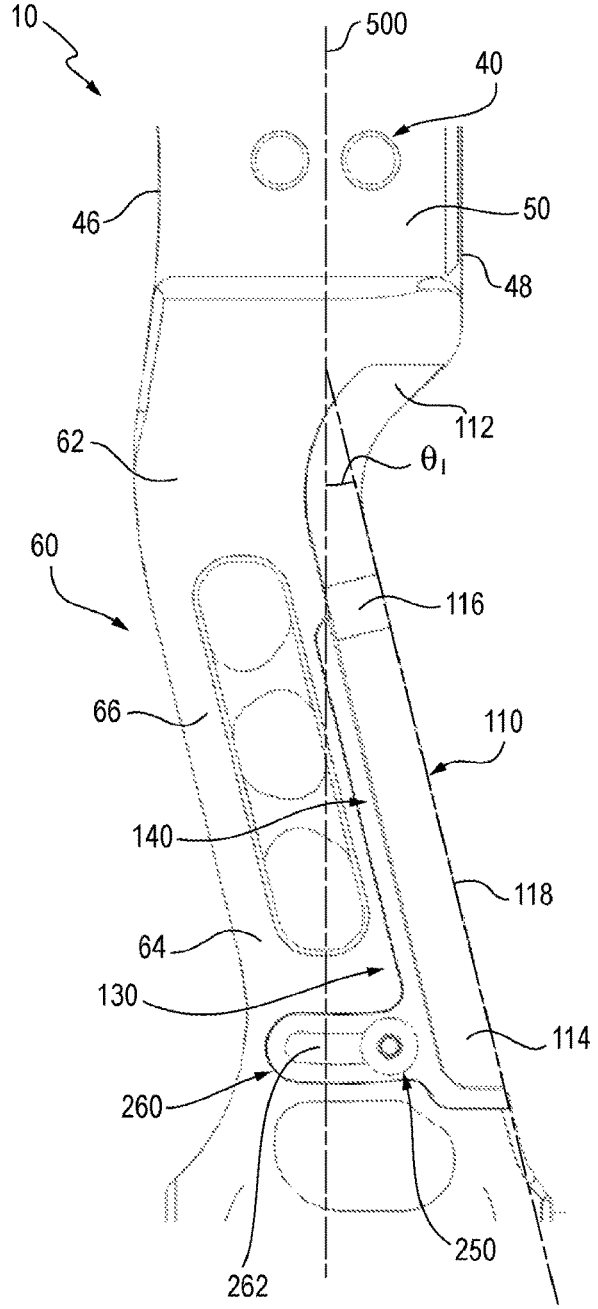
FIG. 5 is a partial side elevation view of an archery bow with a grip assembly in accordance with one embodiment of the present invention in a first position.
Figure 6:
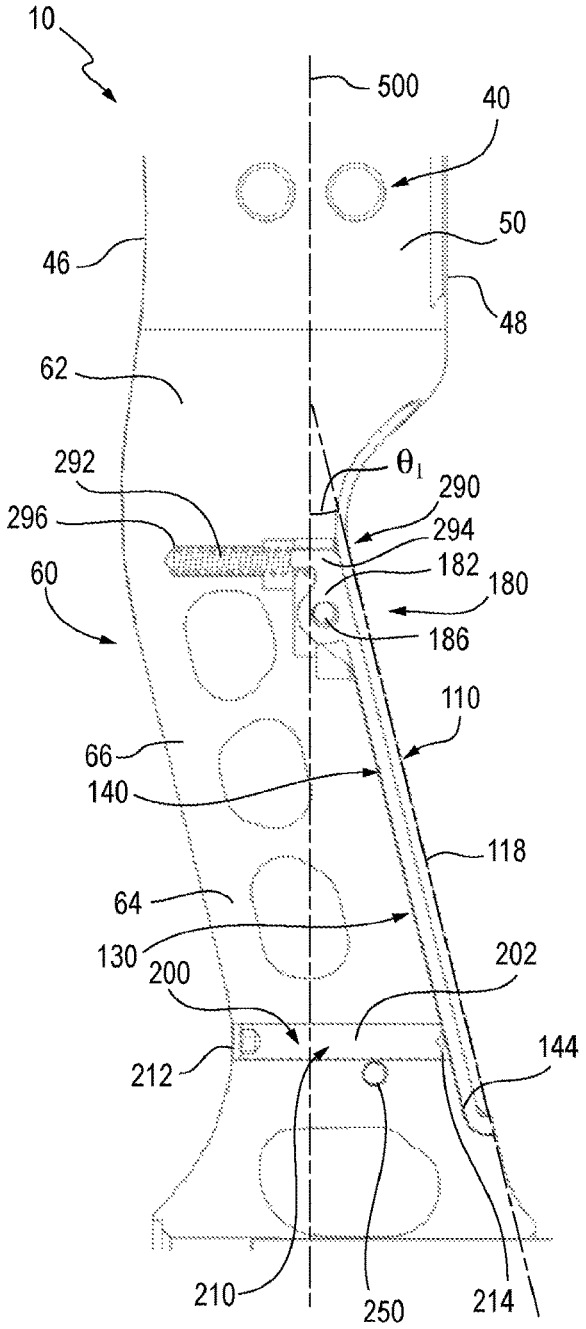
FIG. 6 is a section view of the archery bow of FIG. 5 with the grip assembly in the first position.
Figure 7:
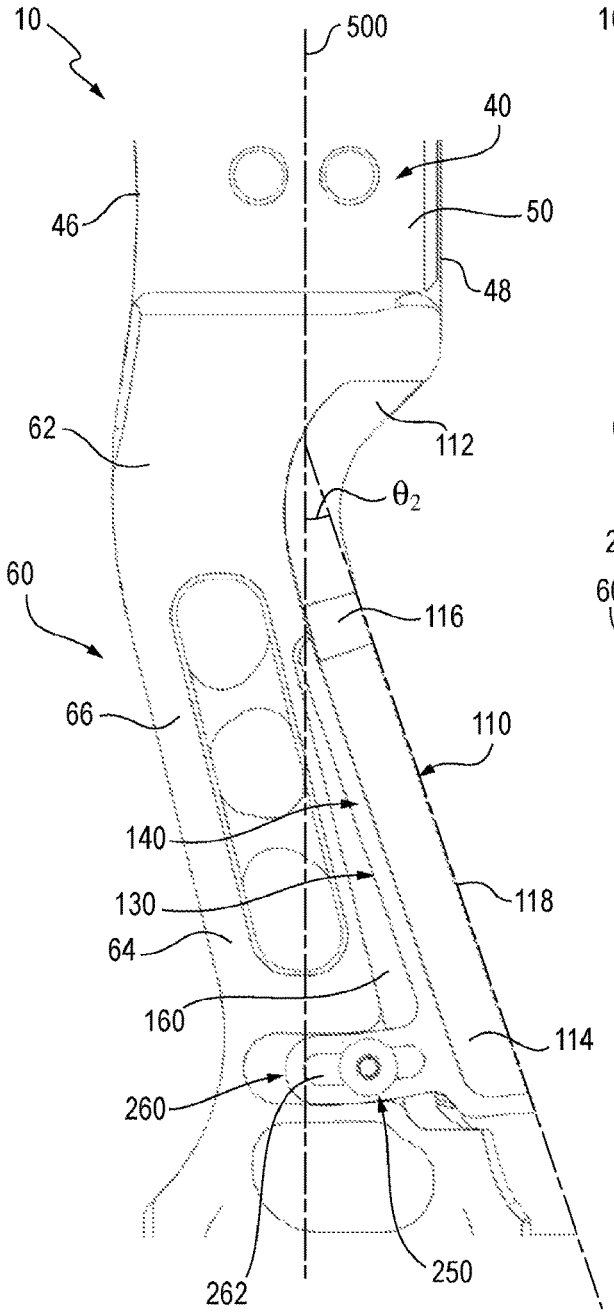
FIG. 7 is a partial side elevation view of the archery bow of FIGS. 5 and 6 with the grip assembly in a second position.
Figure 8:
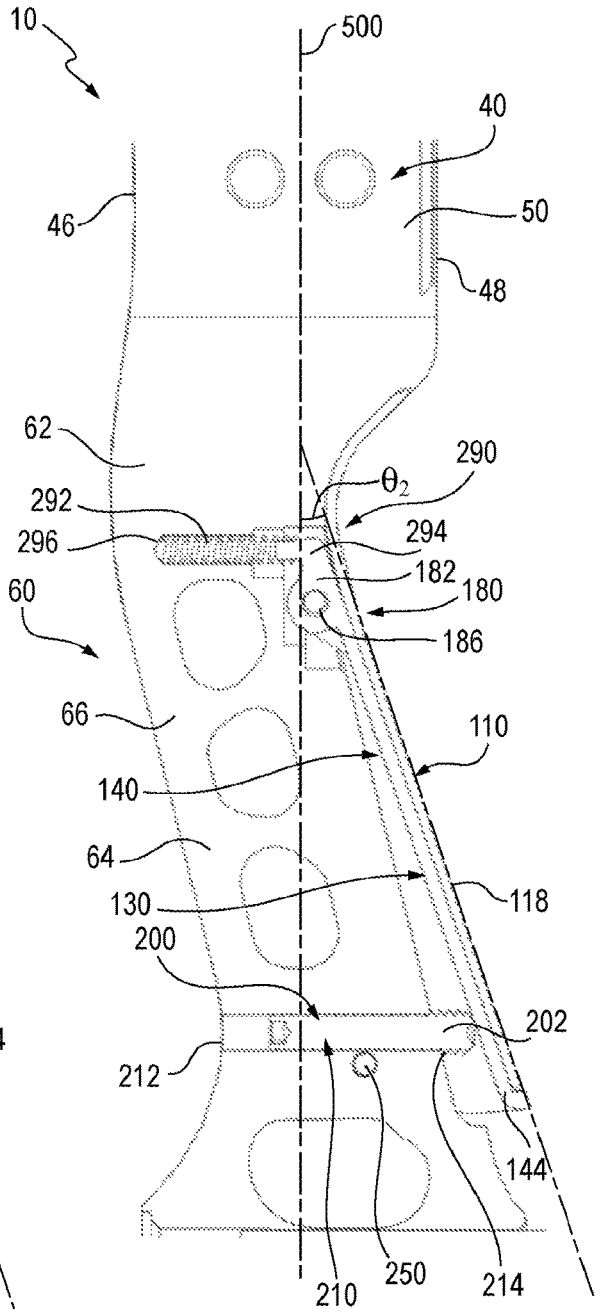
FIG. 8 is a partial side elevation cross-sectional view of the archery bow of FIGS. 5-7 with the grip assembly in the second position.
Figure 9:
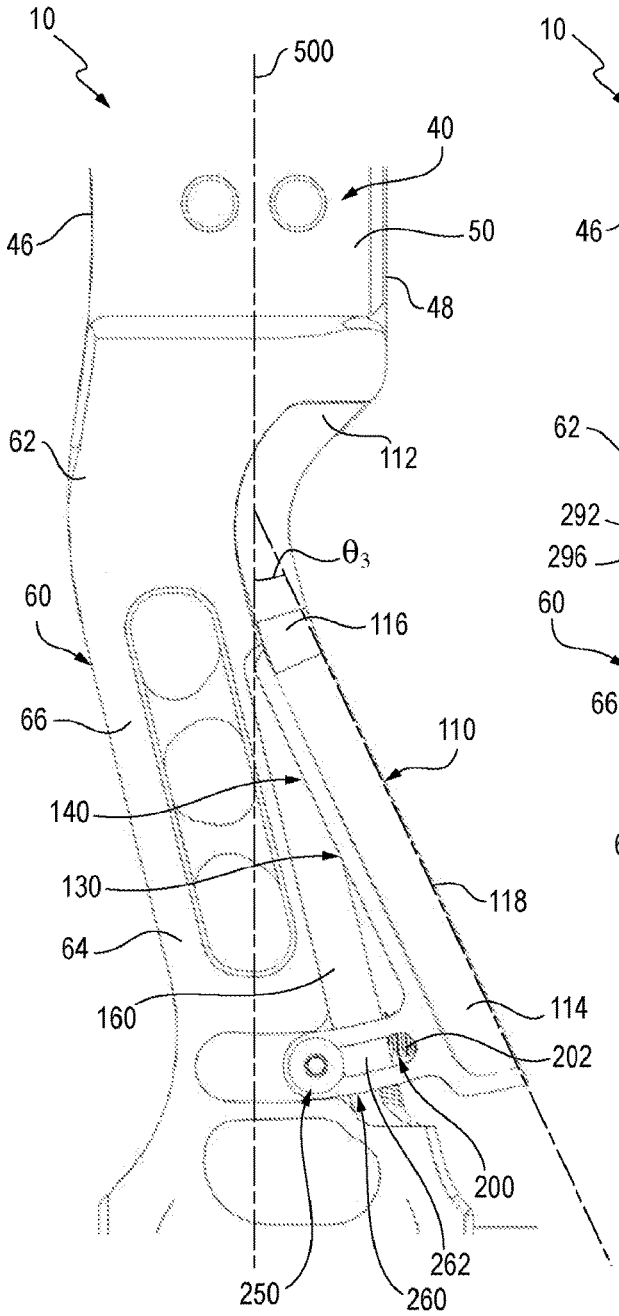
FIG. 9 is a partial side elevation view of the archery bow of FIGS. 5-8 with the grip assembly in a third position.
Figure 10:
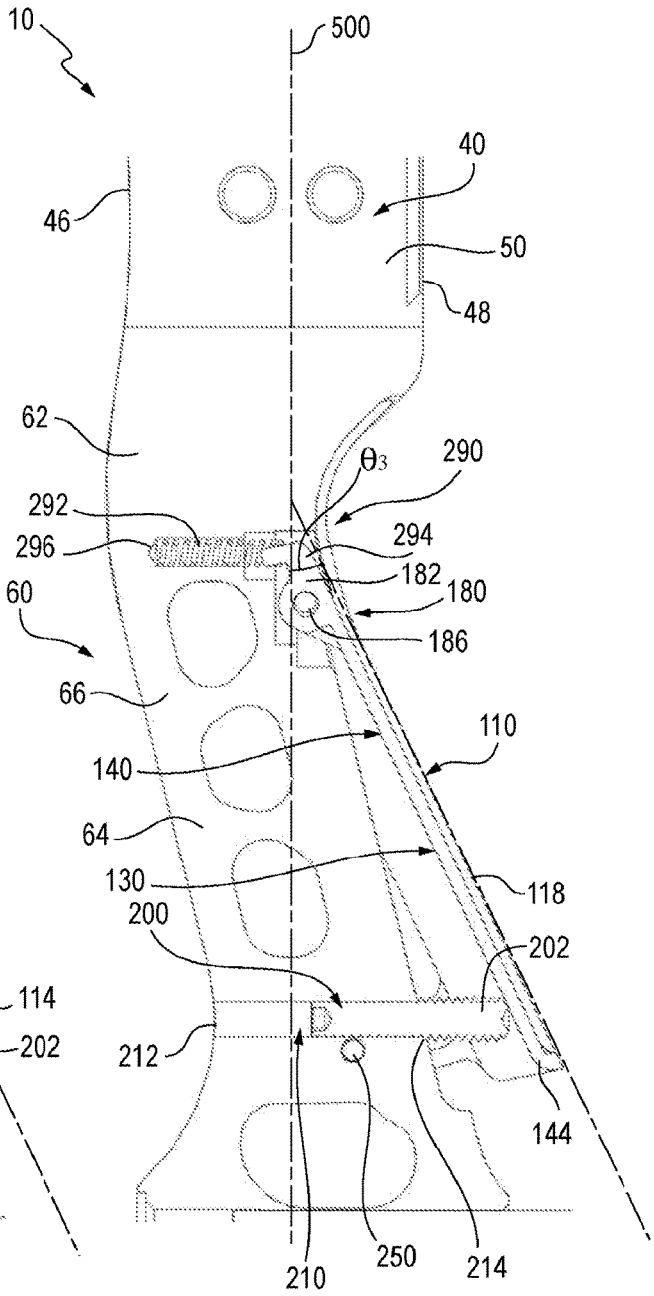
FIG. 10 is a partial side elevation cross-sectional view of the archery bow of FIGS. 5-9 with the grip assembly in the third position.

In one embodiment, the position of the grip bed heel 140 can be selectively adjusted between at least one of a first position (as shown in FIGS. 5 and 6), a second position (as shown in FIGS. 7 and 8), a third position (as shown in FIGS. 9 and 10), as well as positions therebetween. As discussed herein, the angular position of the grip bed heel 140 or the position of the distal portion 144 can be selectively adjusted toward or away from the grip portion 60, including through continuous adjustment or micro-adjustments, by selectively adjusting the adjustment mechanism 200 relative to the riser 40. In one embodiment, a screwing tool (not shown) can be used to screw the adjustment mechanism 200 inwardly or outwardly relative to the riser 40. Further, as discussed above, the set screw 102 can be used to selectively secure the adjustment mechanism 200 at a certain depth relative to the riser 40.

As detailed above, the grip bed heel 140 can be non-permanently selectively secured in a desired position by screwing either or both of the first and second fastening members 230 and 250 into the riser 40 in order to secure the first and second guide tracks 240 and 260 in place against the riser 40.

In a first position, the grip angle $\theta_1$ can define a first angular position of the grip assembly 100, wherein the grip angle $\theta_1$ can be defined as between about 8° and about 18° in one embodiment, between about 12° and about 16° in another embodiment, and be about 14° in yet another embodiment. In further embodiments, the grip angle $\theta_1$ in the first angular position may be about 10°, about 12°, or any other suitable angle, for example. In such a configuration, the linear portion 202 of the adjustment mechanism 200 can be entirely or nearly entirely received within the riser 40, for example within the cylindrical bore 210, and as best illustrated in FIG. 5, the grip bed heel 140 can be adjacent to and generally abut the grip portion 60. As best illustrated in FIG. 5, in one embodiment, the elongate slot 262 of the second guide track 260 and the elongate slot 242 of the first guide track 240 (not shown) can limit the pivotal movement of the grip bed heel 140 inward or toward the riser 40 in the first position. Of course, the seat 162 may also limit the pivotal movement of the grip bed heel 140 inward or toward the riser 40 in the first position. As further illustrated in FIG. 6, the biasing member 292 of the biasing assembly 290 can be received within the cylindrical bore 296 of the riser 40. In such an embodiment, the biasing assembly 290 can provide a moderate rotational counteracting force, including through the biasing member 292 applying a biasing force to the grip bed heel 140 via the connection member 294. Therefore, the biasing assembly 290 can aid to hold the grip bed heel 140 in the first position, including so that the grip bed heel 140 can be adjacent to and abut the grip portion 60, even when the adjustment mechanism 200 may not contact or abut a portion of the grip bed heel 140. As discussed above, the fastening members 230 and 250 may also be tightened to further secure the grip bed heel 140 in place.

In a second position, the grip angle $\theta_2$ can define an intermediate or second angular position of the grip assembly 100, wherein the grip angle $\theta_2$ can be defined as between about 16° and about 24° in one embodiment, between about 18° and about 22° in another embodiment, and be about 20° in yet another embodiment. The magnitude of difference or delta between the first angular position and the second angular position (i.e., the difference between $\theta_1$ and $\theta_2$) can be between about 2° and about 10° in one embodiment, between about 4° and about 8° in another embodiment, and about 6° in yet another embodiment. As best illustrated in FIG. 8, in such configuration, the adjustment mechanism 200 can abut the grip bed heel 140, and the biasing assembly 290 can provide a moderate rotational counteracting force. As further shown in FIG. 8, the length of the linear portion 202 of the adjustment mechanism 200 extending beyond the surface of the riser 40 can generally correspond with the distance between the distal portion 144 and the grip portion 60. As described herein, the adjustment mechanism 200 can overcome the moderate rotational counteracting force provided by the biasing assembly 290 when selectively adjusting the distal portion 144 away from the grip portion 60. As further illustrated in FIG. 8, as the grip angle θ, and therefore the distance between the distal portion 144 and the grip portion 60, is increased, the connection member 294 can compress the biasing member 292 within the cylindrical bore 296. This in turn can cause the biasing assembly 290 to provide the moderate rotational counteracting force, including through the biasing member 292 applying a biasing force in an opposite rotational direction. Therefore, the biasing assembly 290 can aid to non-permanently selectively secure the grip bed heel 140 in the second position, including so that the adjustment mechanism 200 can abut the grip bed heel 140 in near-constant contact.

In a third position, the grip angle $\theta_3$ can define a third angular position of the grip assembly 100, wherein the grip angle $\theta_3$ can be defined as between about 22° and about 30° in one embodiment, between about 24° and about 28° in another embodiment, and be about 25° or about 26° in yet another embodiment. The magnitude of difference or delta between the first angular position and the third angular position (i.e., the difference between $\theta_1$ and $\theta_3$) can be can be between about 8° and about 16° in one embodiment, between about 10° and about 14° in another embodiment, and be about 11° or 12° in yet another embodiment. As best illustrated in FIG. 9, the elongate slot 262 of the second guide track 260 can limit the pivotal movement of the grip bed heel 140 outward or away from the riser 40. As shown in FIG. 10, in such configuration, the adjustment mechanism 200 can abut the grip bed heel 140, and the biasing assembly 290 can provide a moderate rotational counteracting force. As further shown in FIG. 10, the length of the linear portion 202 of the adjustment mechanism 200 extending beyond the surface of the riser 40 can correspond with the distance between the distal portion 144 and the grip portion 60. As described herein, the adjustment mechanism 200 can overcome the moderate rotational counteracting force provided by the biasing assembly 290 when selectively adjusting the distal portion 144 away from the grip portion 60. As further illustrated in FIG. 10, as the grip angle θ, and therefore the distance between the distal portion 144 and the grip portion 60, is further increased, the connection member 294 can further compress the biasing member 292 within the cylindrical bore 296. This in turn can cause the biasing assembly 290 to provide further moderate rotational counteracting force, including through the biasing member 292 applying further biasing force in an opposite rotational direction. Therefore, the biasing assembly 290 can aid to non-permanently selectively secure the grip bed heel 140 in the third position, including so that the adjustment mechanism 200 can abut the grip bed heel 140 in near-constant contact.

As demonstrated in FIGS. 4, 5, 7, and 9, the flexible grip plate 110 is adapted to conform to the stationary grip bed 150 and pivotable grip bed heel 140 in such a way that it provides a transition between the upper section 112 and lower section 114 of the grip that is natural and smooth. In other words, the flexibility of the grip plate 110, and particularly the flexible nature of its intermediate section 116, results in a smooth and natural transition regardless of the grip angle θ to which the grip assembly 100 is adjusted. This provides the archer with a grip having a smooth, consistent, and uniform feel in the archers hand, and a grip that is free from abrupt transitions, pinch points, joints, or edges, including along the back surface 118 and adjacent portions of the grip plate 110. Overmolding the grip plate 110 with a single, flexible material can even further increase the uniform feel of the entire grip.

Another aspect of the present invention is directed to a method for adjusting the hand grip for an archery bow. The method may comprise providing a riser 40 of an archery bow 10, the riser 40 having a grip portion 60, providing a grip assembly 100 to be attached to the grip portion 60, the grip assembly 100 having a grip bed heel 140, determining a preferred position of the grip bed heel 140, and selectively changing or adjusting the position of the grip bed heel 140 to the preferred position, including through continuous adjustment or micro-adjustments to the angular position of the grip bed heel 140 by selectively continuously adjusting or translating an adjustment mechanism 200 contacting or abutting the grip bed heel 140 laterally or linearly between the front surface 46 and the rear surface 48 of the riser 40. The grip assembly may further comprise a grip plate 110 that can be removably secured to the grip bed assembly 130 in a snap-fit manner or similar interference-fit manner, and a back surface 118 of the grip plate 110 can define a certain grip angle θ relative to an axis 500 running longitudinally or vertically and centrally through the archery bow 10. The grip angle θ can vary between a first position, second position, third position, and intermediate positions therebetween.

In this method, a tool (not shown), including, without limitation, a standard screw driver or a standard hex key or Allen wrench, can be (i) used to screw the set screw 102 into and out of the riser 40, (ii) inserted into either the first aperture 212 and/or the second aperture 214 to selectively screw the adjustment mechanism 200 into or out of the riser 40, and (iii) used to selectively and independently screw each of the first fastening member 230 and the second fastening member 250 into and out of the riser 40.

From the accompanying materials, it will be seen that the invention is one well adapted to attain all the ends and objects set forth herein with other advantages which are obvious and which are inherent to the structure. It will be understood that certain features and subcombinations are of utility and may be employed without reference to other features and subcombinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described in the accompanying materials and illustrated in the drawings are presented by way of example only and are not intended to limit the concepts and principles of the present invention. Thus, there has been shown and described several embodiments of a novel invention. As is evident from the description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An archery bow comprising:

a riser having an upper end, a lower end, and a grip portion located between the upper end and the lower end;

an upper limb connected to the upper end of the riser;

a lower limb connected to the lower end of the riser;

a bowstring extending generally between the upper limb and lower limb; and a grip assembly connected to the grip portion and forming a grip bed, wherein the grip assembly comprises:

a grip bed heel having a proximal end and a distal end;

a pivot connection adjacent the proximal end of the grip bed heel, wherein an angle of the grip bed heel relative to the riser is selectively adjustable by pivoting the grip bed heel about the pivot connection; and a grip plate having an upper portion coupled to the riser and a lower portion coupled to the grip bed heel.

2. The archery bow of claim 1, wherein the grip assembly further comprises:

an adjustment mechanism operably coupled with the riser; and a securing mechanism for securing the grip bed heel in an angular position relative to the riser.

3. The archery bow of claim 2, wherein:

the adjustment mechanism comprises a threaded member;

the riser comprises a cylindrical bore that receives the threaded member to varying depths, wherein selectively turning the threaded member varies the depth of the adjustment mechanism within the riser and thereby selectively adjusts an angular position of the grip bed heel.

4. The archery bow of claim 2, wherein the grip assembly further comprises a biasing member that applies a force against the grip bed heel in an opposite rotational direction to a bearing force applied to the grip bed heel by the adjustment mechanism.

5. The archery bow of claim 4, wherein the biasing member engages the grip bed heel above the pivot connection and the adjustment mechanism engages the grip bed heel below the pivot connection.

6. The archery bow of claim 2, wherein the securing mechanism comprises:

at least one guide track coupled to the grip bed heel, the guide track defining a slot; and at least one fastening member that passes through the slot and is received within the riser to secure the grip bed heel in a desired angular position.

7. The archery bow of claim 6, wherein the slot of the at least one guide track is generally arcuate and is generally concentric with the pivot connection of the grip assembly.

8. The archery bow of claim 1, wherein the grip plate further comprises at least one flexible intermediate portion located between the upper portion and the lower portion.

9. The archery bow of claim 8, wherein the at least one flexible intermediate portion of the grip plate comprises a section having a reduced cross-section relative to adjacent portions of the grip plate.

10. The archery bow of claim 8, wherein the flexible intermediate portion comprises at least one void space, and wherein the at least one void space is filled with a flexible material.

11. The archery bow of claim 1, wherein the upper portion of the grip plate is coupled to a seat portion of the riser and the lower portion of the grip plate is coupled to a seat portion of the grip bed heel.

12. A riser for an archery bow, the riser comprising:

a grip bed heel having a proximal end and a distal end;

a pivot connection adjacent the proximal end of the grip bed heel, wherein an angle of the grip bed heel relative to the riser is selectively adjustable by pivoting the grip bed heel about the pivot connection; and a grip plate having an upper portion coupled to the riser and a lower portion coupled to the grip bed heel.

13. The riser of claim 12, wherein the grip plate further comprises at least one flexible intermediate portion located between the upper portion and the lower portion.

14. The riser of claim 13, wherein the at least one flexible intermediate portion of the grip plate comprises a section having a reduced cross-section relative to adjacent portions of the grip plate.

15. The riser of claim 13, wherein the flexible intermediate portion comprises at least one void space, and wherein the at least one void space is filled with a flexible material.

16. The riser of claim 12 further comprising a biasing member that applies a force against the grip bed heel in an opposite rotational direction to a bearing force applied to the grip bed heel by an adjustment mechanism.

17. The riser of claim 16, wherein the biasing member engages the grip bed heel above the pivot connection and the adjustment mechanism engages the grip bed heel below the pivot connection.

18. The riser of claim 12 further comprising a securing mechanism including:

at least one guide track coupled to the grip bed heel, the guide track defining a slot; and at least one fastening member that passes through the slot and is received within the riser to secure the grip bed heel in a desired angular position.

19. The riser of claim 18, wherein the slot of the at least one guide track is generally arcuate and is generally concentric with the pivot connection.

20. A grip assembly for an archery bow having a riser, the grip assembly comprising:

a grip bed heel having a proximal end and a distal end;

a pivot connection adjacent the proximal end of the grip bed heel, wherein an angle of the grip bed heel relative to the riser is adapted to be selectively adjustable by pivoting the grip bed heel about the pivot connection; and a grip plate having an upper portion adapted to be coupled to the riser and a lower portion adapted to be coupled to the grip bed heel.

* * * * *